US010390400B1

(12) United States Patent
Redfield

(10) Patent No.: US 10,390,400 B1
(45) Date of Patent: Aug. 20, 2019

(54) SOFT START CIRCUITRY FOR LED LIGHTING DEVICES WITH SIMULTANEOUS DIMMING CAPABILITY

(71) Applicant: Heartland, Inc., Minneapolis, MN (US)

(72) Inventor: Blake D. Redfield, Sauk Rapids, MN (US)

(73) Assignee: Heartland, Inc., Minneapolis, MN (US)

( * ) Notice: Subject to any disclaimer, the term of this patent is extended or adjusted under 35 U.S.C. 154(b) by 0 days.

(21) Appl. No.: 15/369,402

(22) Filed: Dec. 5, 2016

Related U.S. Application Data

(60) Provisional application No. 62/386,494, filed on Dec. 3, 2015.

(51) Int. Cl.

| | |
|---|---|
| ***H05B 33/08*** | (2006.01) |
| ***F21V 15/015*** | (2006.01) |
| ***F21V 23/00*** | (2015.01) |
| *F21Y 115/10* | (2016.01) |

(52) U.S. Cl.
CPC ..... *H05B 33/0845* (2013.01); *F21V 15/015* (2013.01); *F21V 23/002* (2013.01); *F21Y 2115/10* (2016.08)

(58) Field of Classification Search
CPC ..... H05B 33/0845; F21V 23/002
See application file for complete search history.

(56) References Cited

U.S. PATENT DOCUMENTS

| | | | |
|---|---|---|---|
| 6,392,368 | B1 | 5/2002 | Deller et al. |
| 7,936,132 | B2 | 5/2011 | Quek et al. |
| 8,115,419 | B2 | 2/2012 | Given et al. |
| 8,217,588 | B2 | 7/2012 | McKinney |
| 8,319,445 | B2 | 11/2012 | McKinney et al. |
| 8,334,658 | B2 | 12/2012 | Balakrishnan |
| 9,301,352 | B2 | 3/2016 | Zhu |

(Continued)

FOREIGN PATENT DOCUMENTS

| | | | |
|---|---|---|---|
| CN | 203608428 | U | 5/2014 |

OTHER PUBLICATIONS

"Cree Edge LED Dimming Driver", Cree, Inc., 2013, 1 page.

(Continued)

*Primary Examiner* — Douglas W Owens
*Assistant Examiner* — Pedro C Fernandez
(74) *Attorney, Agent, or Firm* — Albert W. Watkins

(57) ABSTRACT

A soft start circuit device couples at the junction between a 0-10 volt DC dimmer and an LED driver. A first wire couples with the positive polarity dimmer output, and a second wire couples with the negative polarity dimmer output. A capsule provides electrical insulation and physical consolidation and isolation to the capsule interior, and the first and second wires each pass through the capsule wall into the capsule interior. A capacitor and resistor are retained in the capsule interior and are each electrically coupled in parallel across the first and second wires. A sealant fills the capsule interior. At least one indicium is affixed with each wire, to indicate proper polarity connection with the 0-10 volt DC dimmer output. The capsule may further comprise a generally cylindrical and light transmissive polycarbonate packaging tube, and first and second end caps. The sealant may also comprise a light transmissive silicone sealant.

21 Claims, 7 Drawing Sheets

(56) References Cited

U.S. PATENT DOCUMENTS

| | | | | |
|---|---|---|---|---|
| 2007/0274067 | A1* | 11/2007 | Sloan | F21V 15/015 362/219 |
| 2011/0182074 | A1* | 7/2011 | Hemerle | F21V 27/02 362/294 |
| 2011/0309759 | A1* | 12/2011 | Shteynberg | H05B 33/0815 315/201 |
| 2017/0089528 | A1* | 3/2017 | He | F21S 4/20 |

OTHER PUBLICATIONS

"Cree XLamp LED Electrical Overstress", Cree, Inc., Application Note CLD-AP29 Rev 1E, 2010-2016, 9 pages.
Goodman, P., "Avoiding current spikes with LEDs," NA04, 4 pages, available from ww.philipslumileds.com/uploads/246/NA04-pdf.

* cited by examiner

SOFT START CIRCUITRY FOR LED LIGHTING DEVICES WITH SIMULTANEOUS DIMMING CAPABILITY

CROSS REFERENCE TO RELATED APPLICATIONS

The present application claims the benefit of U.S. provisional patent application 62/386,494 filed Dec. 3, 2015 of like title and inventorship, the teachings and entire contents which are incorporated herein by reference.

BACKGROUND OF THE INVENTION

1. Field of the Invention

The present invention is directed generally to soft start Light Emitting Diode (LED) lighting, and more particularly to retrofitting existing commercially available circuitry to provide enhanced soft start circuitry amenable to energizing LED based lighting devices.

2. Description of the Related Art

Inrush current is generally a momentary current surge in an electrical device occurring when a power control device is first activated. The term is also sometimes used to refer to the maximum, instantaneous input current drawn by an electrical device when first turned on. Inrush current typically reduces to a lower steady-state current during normal device operation. The effect of significant inrush current can be highly detrimental to many different electrical components and circuits, including not only the components directly receiving the elevated inrush current, but also downstream components or separate devices sharing a common power line with the directly affected components. Inrush currents can damage device components, lower supply voltage available to other circuits, decrease power efficiency, cause system errors, make devices difficult to control, and complicate device design. For example, if the input power source for a device is current limited or has poor load regulation, large inrush currents can cause the input voltage to drop significantly, thereby affecting overall device operation. While many devices are subject to problematic inrush currents, DC-to-DC converters and power amplifiers are particularly susceptible because of input capacitors and/or filter element charging that occurs when power is first provided to such devices.

Soft-start circuits can be used to alleviate the problems associated with inrush currents. This is typically accomplished by ramping up the output of the power control device (e.g., a DC-to-DC converter) at a rate slower than would otherwise occur without the soft-start circuit. Numerous different types of soft-start circuits have been implemented, including for exemplary purpose: soft-start circuits that delay full current output of a power converter by linearly increasing a pulse width modulator's pulse width; soft start circuits that ramp a reference voltage to an error amplifier from zero to its nominal value, thereby easing the output voltage up at a slower rate; and soft-start circuits that limit the device closed loop feedback until the soft start voltage is higher than the desired voltage reference to the error amplifier, during the time interval while the desired output is reached.

Soft-start circuits for LED lights have additional challenges that are desirable to address beyond those of a typical multi-purpose power supply. One of these issues is the starting and illuminating of the LEDs. Even when a power supply has been designed to start up and reach stable power levels prior to powering one or more LEDs, the LEDs will also undergo a significant and sudden heating when power is initially applied.

This sudden heating may not alter the inrush current in a well-designed power supply, but it will nevertheless affect the reliability of the LED or bank of LEDs. This is because as devices change temperature, they expand and contract. Sudden heating will in most materials lead to sudden thermal expansion. If the materials are not sufficiently malleable, this expansion can cause devices including LEDs to fracture and break, thereby resulting in catastrophic failure of the LED.

In the case of an LED is coupled securely to a heat sink, sudden heating within the LED may not only increase the risk of damage to the LED, but it will also lead to sudden differential thermal expansion at the junction between the LED and the heat sink or bond pads. In other words, the LED may get quite hot and expand before the heat sink or bond pad even warms up. This can cause the LED to separate from the heat sink or bond pad, depriving the LED of vital cooling or electrically disconnecting the LED, in either case eventually leading to failure.

In addition to reliability, soft starting of lights is also beneficial to persons exposed to the light. As we all know, a very sudden transition from dark to bright illumination can be quite disconcerting. Consequently, a more gradual transition from dark to light that allows more time for a person's pupils to contract is also desirable.

One approach that permits a more gradual transition from dark to light, and which allows a user to select a desired illumination intensity, is the provision of a dimmer that can control an LED driver output, which in turn then controls the illumination intensity of the LEDs. The vast majority of commercially available LED lights accomplish this dimming through an industry standardized 0-10 volt DC dimmer control. The output voltage from the dimmer control, which as implied is designed to be controlled to vary between zero and ten volts, is then used as an input to an LED driver. The LED driver will in turn use this voltage level to effect a particular illumination intensity.

It is important to note that the industry standard 0-10 volt DC dimmer control does not provide working power to the LED lights, and instead merely provides a control signal to the LED driver. While these industry standard dimmers may be used to gradually increase the intensity of an LED light, this would require a person to dim the lights using the dimmer control prior to switching the lights off, and then switching the lights on and manually adjusting the dimmer control to gradually increase the illumination intensity. As may be appreciated, this is inconvenient, and as a result, many times when a user switches on power to the LED lights, they will do so by simply toggling a light switch, which will instantaneously energize the lights to the full intensity that they were last set to. As described above, this can both reduce the life expectancy of the LED light and cause discomfort for those exposed to the instantaneous change in light intensity.

There are a few more recent LED dimmer circuits that have been designed to provide a soft start of the LED light intensity. Unfortunately, many LED dimmers and drivers have been fabricated and installed that do not address the soft starting of the LEDs, leading to decreased reliability and greater user discomfort. These installed driver circuits are quite complex, and heretofore could not be field modified.

A small subset of exemplary U.S. and Foreign patents representative of a myriad of LED lighting circuits, the teachings which are incorporated herein by reference, include: U.S. Pat. No. 6,392,368 by Deller et al, entitled "Distributed lighting control system"; U.S. Pat. No. 7,936,132 by Quek et al, entitled "LED lamp"; U.S. Pat. No. 8,115,419 by Given et al, entitled "Lighting control device for controlling dimming, lighting device including a control device, and method of controlling lighting"; U.S. Pat. No. 8,217,588 by McKinney, entitled "Adaptive dimmable LED lamp"; U.S. Pat. No. 8,319,445 by McKinney et al, entitled "Modified dimming LED driver"; U.S. Pat. No. 8,334,658 by Balakrishnan, entitled "Dimmer-disabled LED driver"; U.S. Pat. No. 9,301,352 by Zhu, entitled "Method and circuit for driving an LED load with phase-cut dimmers"; and CN 203608428 by Zhang et al, entitled "Four-in-one light modulation circuit of LED driving power supply".

In addition to the foregoing patents, Webster's New Universal Unabridged Dictionary, Second Edition copyright 1983, is incorporated herein by reference in entirety for the definitions of words and terms used herein.

As may be apparent, in spite of the enormous advancements and substantial research and development that has been conducted, and given the benefits that may be obtained by soft starting LEDs and the level of complexity of currently installed LED dimmers and drivers, there still remains a need for a simple, easy to fabricate, and cost effective design which can be field installed to realize a soft start circuit to energize LED lighting devices.

SUMMARY OF THE INVENTION

The present invention is directed generally to soft start LED lighting, and more particularly to retrofitting existing commercially available circuitry to provide enhanced soft start circuitry amenable to energizing LED based lighting devices.

In a first manifestation, the invention is a soft start circuit device configured to soft start light emitting diode (LED) devices. A capsule has a wall separating an interior from an exterior thereof, and provides electrical insulation and physical consolidation and isolation to the capsule interior. A first wire and a second wire each pass from the capsule exterior through the capsule wall into the capsule interior. A capacitor is retained in the capsule interior and has a first terminal electrically coupled to the first wire and a second electrical terminal electrically coupled to the second wire. The first wire is configured to electrically couple to a negative polarity electrical junction between an output of a 0-10 volt DC LED dimmer and a dimmer input of an LED driver. The second wire is configured to electrically couple to a positive polarity electrical junction between the output of the 0-10 volt DC LED dimmer and the dimmer input of said LED driver.

In a second manifestation, the invention is, in combination, a 0-10 volt DC dimmer having a positive polarity dimmer output and a negative polarity dimmer output, an LED driver having a positive polarity dimmer input, a negative polarity dimmer input, a line voltage input, and an LED power supply output, and a soft start circuit device coupled through a first wire with said positive polarity dimmer output to said LED driver positive polarity dimmer input, and coupled through a second wire with said negative polarity dimmer output to said LED driver negative polarity dimmer input. The soft start circuit device comprises a capsule having a wall separating an interior from an exterior thereof that provides electrical insulation and physical consolidation and isolation to the capsule interior. The first and said second wires each pass from the capsule exterior through the capsule wall into the capsule interior. A capacitor retained in the capsule interior has a first terminal electrically coupled to the first wire and a second electrical terminal electrically coupled to the second wire. A resistor retained in the capsule interior has a first terminal electrically coupled to the first wire and a second electrical terminal electrically coupled to the second wire. At least one indicium is affixed with the first wire indicative of a 0-10 volt DC dimmer negative polarity connection. At least one indicium is affixed with the second wire is indicative of a 0-10 volt DC dimmer positive polarity connection.

In a third manifestation, the invention is, in combination, a 0-10 volt DC dimmer having a positive polarity dimmer output and a negative polarity dimmer output, an LED driver having a positive polarity dimmer input, a negative polarity dimmer input, a line voltage input, and an LED power supply output, and a soft start circuit device. The soft start circuit device consists essentially of: a first wire coupled with the positive polarity dimmer output to the LED driver positive polarity dimmer input; a second wire coupled with the negative polarity dimmer output to the LED driver negative polarity dimmer input; a capsule having a wall separating an interior from an exterior thereof and providing electrical insulation and physical consolidation and isolation to the capsule interior, the first and second wires each passing from the capsule exterior through the capsule wall into the capsule interior; a capacitor retained in the capsule interior having a first terminal electrically coupled to the first wire and a second electrical terminal electrically coupled to the second wire; a resistor retained in the capsule interior having a first terminal electrically coupled to the first wire and a second electrical terminal electrically coupled to the second wire; a sealant generally filling the capsule interior; at least one indicium affixed with the first wire indicative of a 0-10 volt DC dimmer negative polarity connection; and at least one indicium affixed with the second wire indicative of a 0-10 volt DC dimmer positive polarity connection.

OBJECTS OF THE INVENTION

Exemplary embodiments of the present invention solve inadequacies of the prior art by providing an electronic circuit to soft start LEDs comprising a capacitor configured in parallel electrical communication with a resistor. The output of parallel resistor capacitor (RC) circuit is configured to be field coupled in electrical communication with the dimming circuit input of an LED driver module.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to enable an LED light to be soft started to both prolong the life of the LED(s) and to reduce user discomfort. A second object of the invention is to provide automated soft start of the LED(s) without the inconvenience of manual intervention. Another object of the present invention is to enable field installation of necessary electrical components to achieve automated soft start of the LED(s). A further object of the invention is to provide a safe, compact, and easily handled and installed apparatus that provides an installer clear visual direction for intuitive installation. Yet another object of the present invention is to enable visual identification of internal failure for ready troubleshooting.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides a preferred embodiment soft start circuit device 10 amenable to retrofitting existing 0-10 volt DC dimmer and LED driver circuits, to induce soft start energization of LED based lighting devices. Preferred embodiment soft start circuit device 10 provides several electrical components in a package housing 20 suitable for intuitive field installation.

Figure 1:
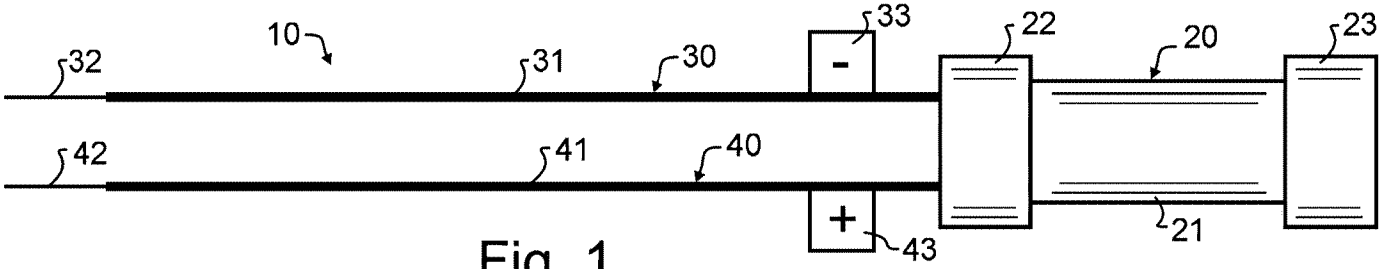
FIG. 1 illustrates a preferred embodiment soft start circuit device for led lighting devices with simultaneous dimming capabilities designed in accord with the teachings of the present invention from a top plan view.

Preferred embodiment soft start circuit device 10 designed in accordance with the teachings of the present invention is depicted in finished form in FIG. 1, ready for installation. A capsule 20 is constructed from a generally cylindrical packaging tube 21 and a pair of end caps 22, 23. Extending from end cap 22 are a pair of electrical wires 30, 40. Wire 30 has suitable insulation 31 encompassing all but the exposed terminal end of conductor 32. Wire 40 has suitable insulation 41 that likewise preferably encompasses all but the exposed terminal end of conductor 42. In preferred embodiment soft start circuit device 10, conductors 32, 42 are solid copper. However, in an alternative embodiment contemplated herein, conductors 32, 42 may be stranded wire, and in a further alternative embodiment, the stranded wire may be tinned at adjacent the terminal ends to prevent the strands from separating from each other. In an even further alternative embodiment, conductors 32, 42 may be stranded and tinned throughout their entire length.

To facilitate proper installation, most preferably insulation 31 is color coded to comply with standard 0-10 volt DC dimmer wiring, which uses gray to indicate the negative dimmer wire. In addition, a tag 33 is preferably affixed to wire 30 that is marked on both sides with a minus sign. In alternative embodiments, either the color coding of insulation 31 or tag 33 would provide ready visual indication to an installer of the proper connection point into a lighting circuit, but the combination of indicia is most preferred.

In a similar manner, insulation 41 is also color coded to comply with standard 0-10 volt DC dimmer wiring, which uses violet as the positive dimmer wire. In addition, a tag 43 is preferably affixed to wire 40 that is marked on both sides with a plus sign.

Figure 2:
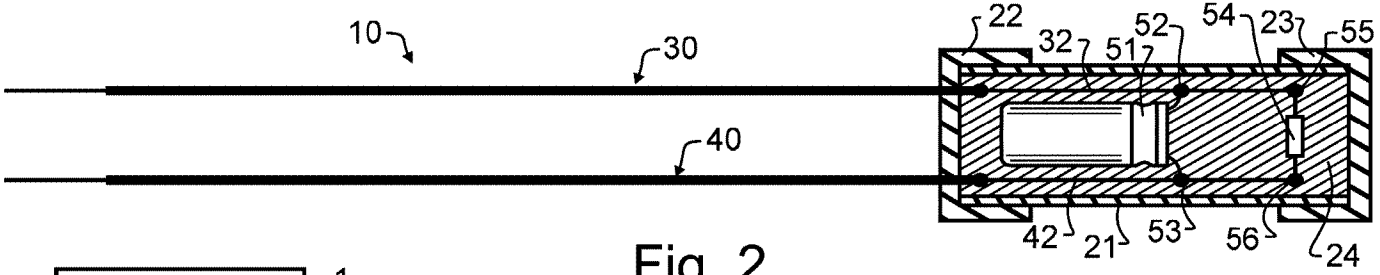
FIG. 2 illustrates the preferred embodiment soft start circuit device of FIG. 1 from a partial sectional view, showing the internal arrangement of components.

FIG. 2 illustrates the internal arrangement of components within capsule 20. In preferred embodiment soft start circuit device 10, wires 30, 40 are stripped of insulation 31, 41, leaving only conductors 32, 42 extending through the majority of capsule 20. Midway along the stripped length of conductors 32, 42, a capacitor 51 is secured an electrically connected to the conductors.

In preferred embodiment soft start circuit device 10, capacitor 51 is an electrolytic capacitor, and may for exemplary purposes comprise a 20 microfarad capacitor rated to withstand sufficient voltage to safely operate when connected at the dimmer input of an LED driver. Electrolytic capacitors generally have substantial energy storage density, which permits capsule 20 to be quite small. However, other suitable capacitor types may be used, preferably which facilitate a small capsule. The negative lead wire 52 from electrolytic capacitor 51 is securely connected to conductor 32, such as by wrapping and soldering about conductor 32, and the positive lead wire 53 is likewise securely connected to wrapped and soldered about conductor 42, again such as by wrapping and soldering. While wrapping and soldering is disclosed herein as one preferred method of both electrically and mechanically securely coupling capacitor 51 to conductors 32, 42, any other suitable techniques may be used, including for exemplary and non-limiting purpose slipping the wires within a ferrule and crimping them together.

An electrical resistor 54 is similarly affixed with lead wire 55 wrapped and soldered about conductor 32, and lead wire 56 wrapped and soldered about conductor 42. While wrapping and soldering is disclosed herein as one preferred method of both electrically and mechanically securely coupling electrical resistor 54 to conductors 32, 42, any other suitable techniques may be used, including for exemplary and non-limiting purpose slipping the wires within a ferrule and crimping them together. Resistor 54 functions primarily as a bleed resistor, designed to discharge capacitor 51 when no power is applied. As a result, a relatively high resistance is acceptable, and when used in combination with a 20 microfarad capacitor, a 105 kilohm resistor is preferred. The spacing between capacitor 51 and resistor 54 is not critical to the operation of the preferred embodiment, and so these two components may be closer or farther than illustrated.

Capsule 20 defines a wall that separates an interior of the capsule from an exterior thereof. Capsule 20 additionally provides electrical insulation and physical consolidation and isolation to the capsule interior and the capacitor 51, resistor 54, and wires 30, 40 therein.

In preferred embodiment soft start circuit device 10, generally cylindrical packaging tube 21 may be a clear, durable, electrically stable and non-conductive, thermally resistant, and flame retardant material. A preferred composition is polycarbonate plastic, which performs well in each area, even without the addition of fire retardants and the like. Nevertheless, other materials including other plastics, particularly with fire retardant and other additives as may be required, glass, ceramic compositions, laminates or composites, and even metals may be used in alternative embodiments. End caps 22, 23 may be similar material, but in the preferred embodiment these are instead fabricated from vinyl.

To prevent undesirable motion within capsule 20, packaging tube 21 is preferably filled with a suitable sealant 24. In the preferred embodiment, an electronic grade silicone sealant is used. The silicone sealant helps to protect the internal components against condensation, while also holding the parts firmly in place. Additional electrical insulation is also provided by the sealant. In addition, silicone sealant is resilient, such that in the event of catastrophic and explosive or expansive failure of either capacitor 51 or resistor 54, the sealant can momentarily stretch and expand without exposing electrically conductive components. Silicone sealant is also extremely fire retardant and thermally stable. The inherent resilience of the sealant also allows the exterior of packaging tube 21 to be deformed, while not damaging the components inside the tube. Nevertheless, in alternative embodiments other encapsulants and sealants may be used.

If generally cylindrical packaging tube 21 is either clear or translucent, and if sealant 24 is also clear or translucent, then the internal components within packaging tube 21 can be visually inspected. In the case of a catastrophic failure, this may then easily be visually identified.

Figure 3:
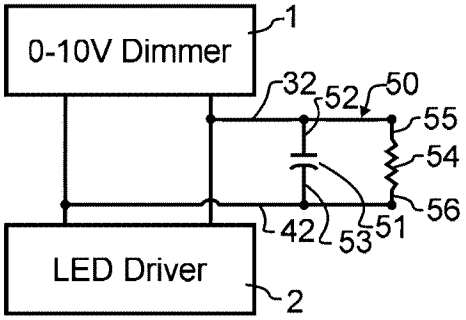
FIG. 3 illustrates the preferred embodiment soft start circuit device of FIG. 1 by schematic diagram.

As illustrated in FIGS. 2 and 3, resistor 54 and capacitor 51 are connected in a parallel electrical circuit configuration, and the violet and gray leads depicted in FIG. 1 are to be connected to the electrical junction between an output of an exemplary prior art 0-10 volt DC LED dimmer1 and the dimming input of exemplary prior art LED driver2, sometimes referred to as a light emitting diode (LED) power supply. Hereafter, the RC circuit depicted in FIG. 3 will be referred to as a "soft start" circuit. The goal of preferred embodiment soft start circuit device 10 is to minimize the large inrush current described above and have the output current of LED driver 2 ramp up gradually, rather than instantaneously.

The soft-start circuitry described above is connected into existing LED drivers at the input received from a 0-10 volt DC dimmer, using the same color-coded insulation provided on the dimmer outputs. This connection may for exemplary and non-limiting purpose be made by twisting the three wires at each junction together using the well-known Wire-Nut™ fasteners and similar connectors, through a terminal block, or by twisting and soldering the wires together.

Various embodiments of apparatus designed in accord with the present invention have been described, and illustrated in the various figures. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases either unnumbered or like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

Figure 4:
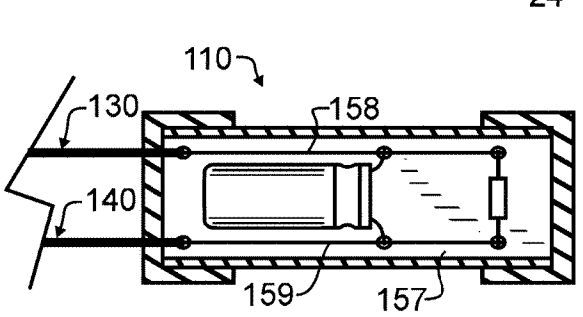
FIG. 4 illustrates a first alternative embodiment soft start circuit device from a partial sectional view similar to the view of FIG. 2.

FIG. 4 illustrates a first alternative embodiment soft start circuit device 110 from a partial sectional view similar to the view of FIG. 2. In this instance, rather than affixing capacitor 51 and resistor 54 directly to conductors 32, 42, a printed circuit board (PCB) 157 has been provided. PCB 157 may be of any suitable composition, and so for exemplary and non-limiting purpose may comprise a phenolic resin, a glass-epoxy composition, a porcelain on metal substrate, a ceramic such as alumina, or any other suitable composition. In this case, a pair of parallel conductors 158, 159 are "printed" or formed on PCB 157. Wires 130, 140 are soldered or otherwise bonded and electrically connected at a first end of PCB 157. Capacitor 151 is connected by soldering or otherwise bonding and electrically connecting negative lead wire 152 to conductor 158 and positive lead wire 153 to conductor 159. Electrical resistor 154 is likewise connected by soldering or otherwise bonding and electrically connecting lead wire 155 to conductor 158 and lead wire 156 to conductor 159. While not illustrated, silicone sealant 24 or other suitable encapsulant may still be used to encapsulate the resulting circuit. One inherent disadvantage of this alternative embodiment soft start circuit device 110 is that most printed circuit boards are opaque, meaning PCB 157 blocks the view of capacitor 151 and resistor 154 when a person is facing the back side of PCB 157. Another disadvantage is that PCB 157 would typically be placed at the center of packaging tube 121, meaning either packaging tube 121 must be larger than packaging tube 21, or packaging tube 121 must take another geometry besides cylindrical to best accommodate the circuit therein. In this alternative embodiment then, packaging tube 121 may for exemplary purposes have a triangular cross-section, rather than a round cross-section.

In order to demonstrate the universal compatibility of preferred embodiment soft start circuit device 10 described in FIGS. 1-3, experimental data was collected utilizing preferred embodiment soft start circuit device 10 with three of the most common forms of power supplies utilized with LED lighting devices: magnetic contactor; toggle switch; and zero crossing power supplies. For each type of power supply, inrush current was measured both with and without preferred embodiment soft start circuit device 10 attached, and those individual experimental results are described below.

Figure 5:
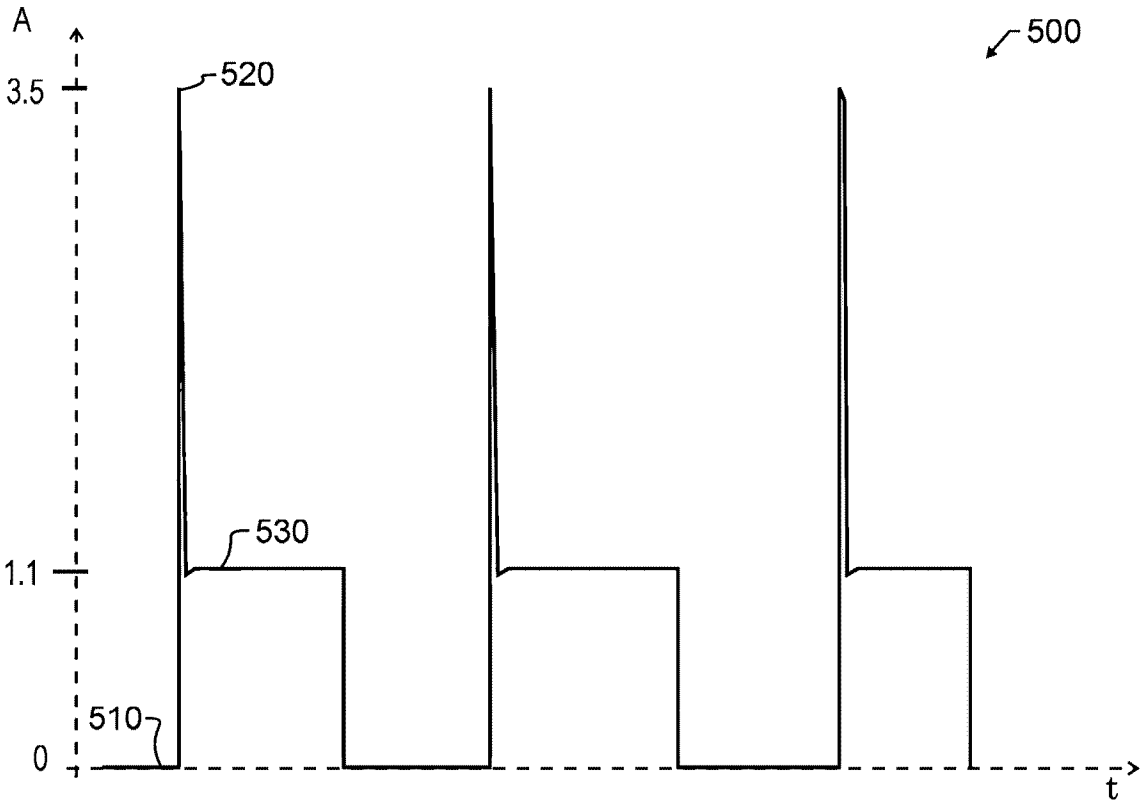
FIGS. 5 and 6 depict graphically the results of testing the inrush current for a magnetic contactor power supply both without (FIG. 5) and with (FIG. 6) the preferred embodiment soft start circuit device attached thereto.
Figure 6:
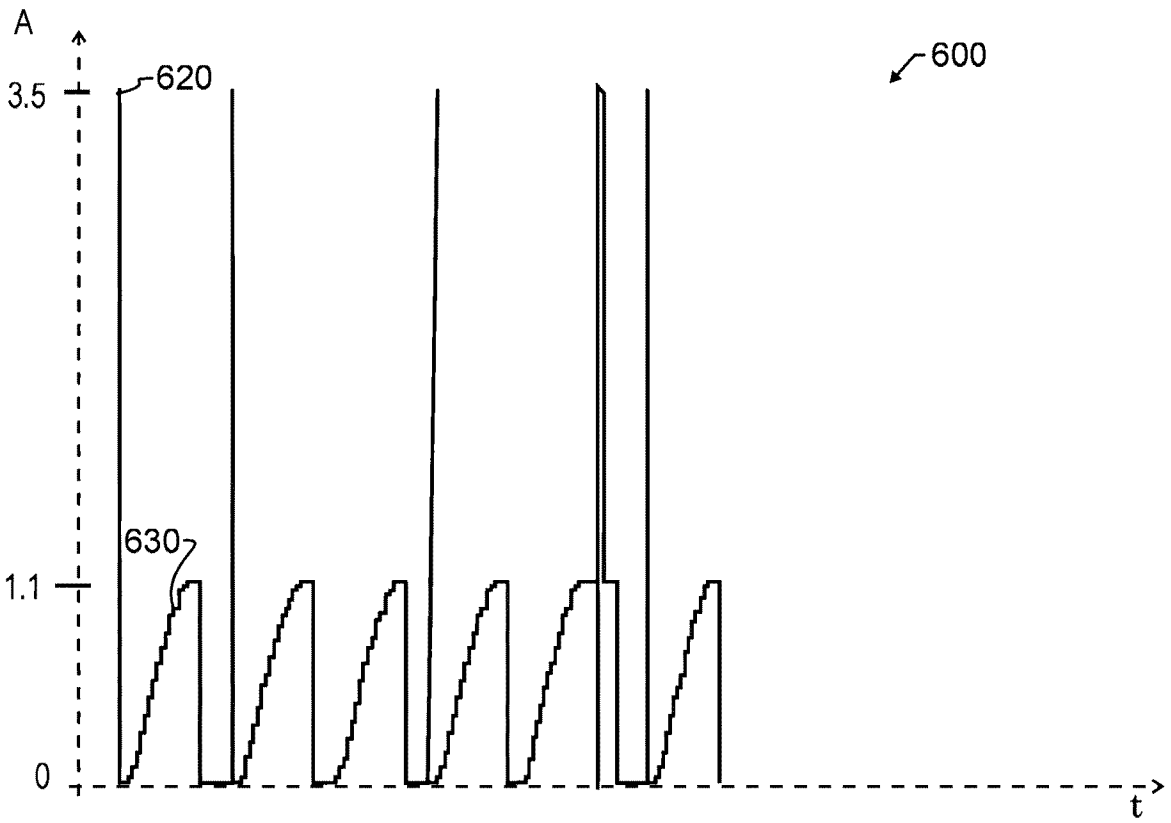

FIGS. 5 and 6 depict graphically the results of testing the current draw, including inrush current, for a magnetic contactor power supply both without (FIG. 5) and with (FIG. 6) preferred embodiment soft start circuit device 10 attached thereto. FIG. 5 shows a transition from an off state at 510 drawing no current to an instantaneous 3.5 amp peak inrush of current 520, followed closely by an approximate 1.1 amp steady draw 530 on the power supply in a square wave type fashion. This inrush nature is repeated over multiple on/off cycles with similar results. In contrast to this, FIG. 6 shows the same magnetic contactor power supply with preferred embodiment soft start circuit device 10 attached. FIG. 6 shows the same instantaneous 3.5 amp current inrush 620, consistent with capacitor charging and the like. However, also shown in FIG. 6, the current draw on the power supply shows a somewhat linear ramp 630 spread over approximately 30 seconds ultimately to the same steady state current of approximately 1.13 amps. However in this configuration, the rms average current supplied by the power supply during the charging ramp 630 is approximately 0.19 amps, an 83% reduction in the average current supplied by the power supply during the time duration of ramp 630 required to bring the LED lighting device to maximum/steady state light output. This much softer start of illumination intensity will both prolong the life of the LED(s) and reduce user discomfort.

Figure 7:
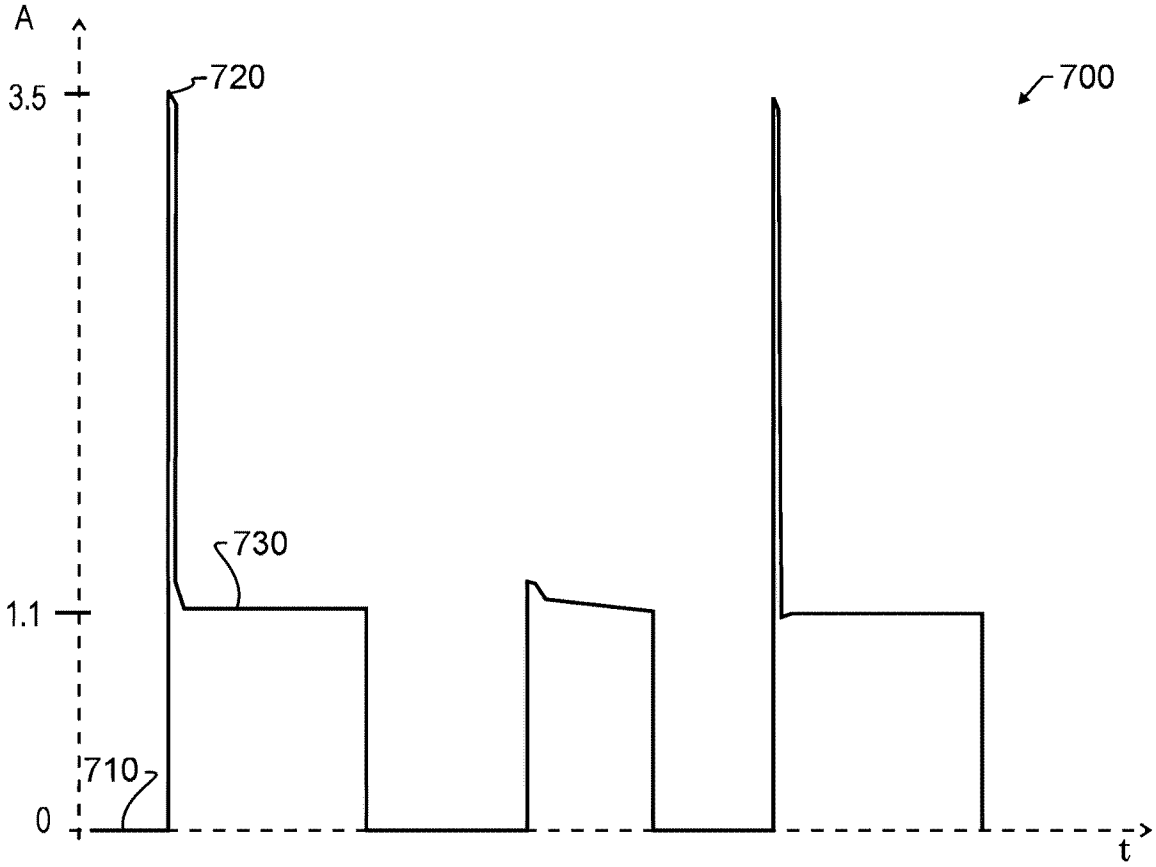
FIGS. 7 and 8 depict graphically the results of testing the inrush current for a toggle switch power supply both without (FIG. 7) and with (FIG. 8) the preferred embodiment soft start circuit device of FIG. 1 attached thereto.
Figure 8:
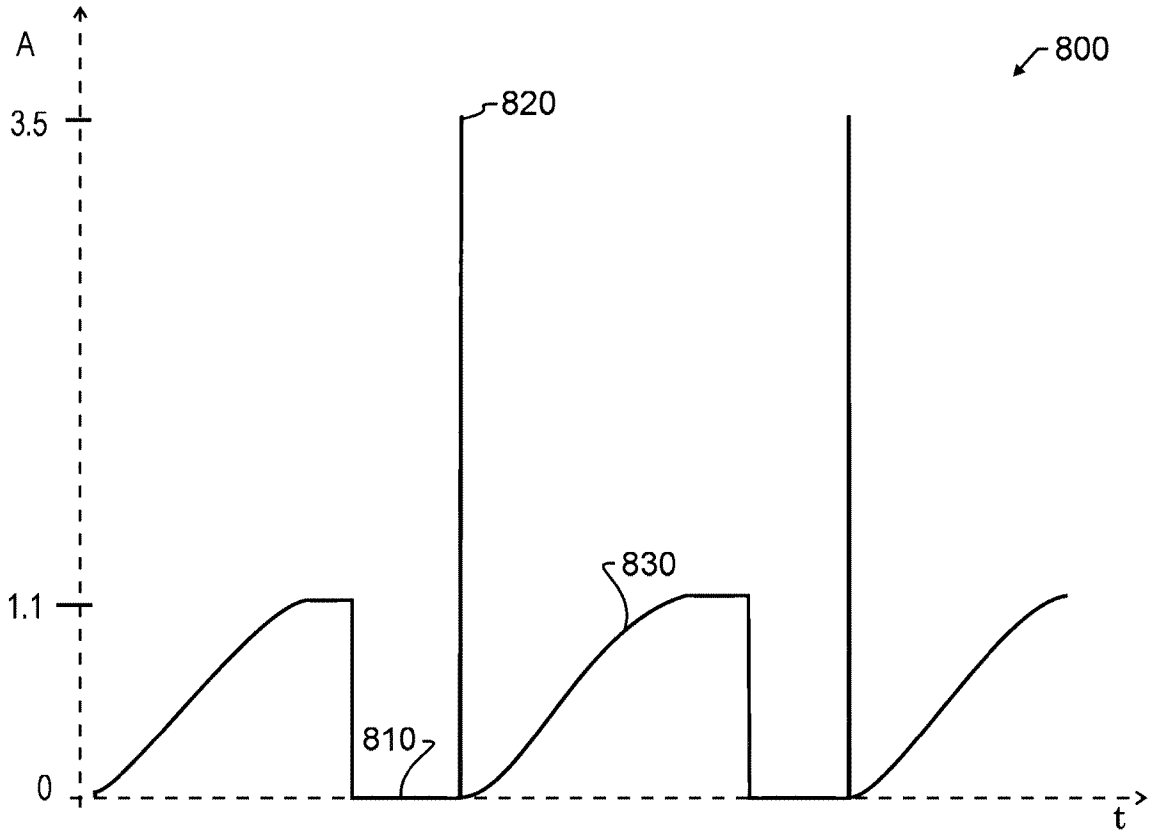

FIGS. 7 and 8 tell a similar story for toggle switch type power supplies. FIG. 7 shows the results of powering on and off a toggle switch type power supply without preferred embodiment soft start circuit device 10 attached. As before, FIG. 7 shows an instantaneous 3.5 amp inrush of current 720 followed closely by an approximate 1.1 amp steady draw 730 on the power supply in a square wave type fashion. This inrush nature is repeated over multiple on/off cycles with similar results. In contrast to this, FIG. 8 shows the same toggle switch power supply with preferred embodiment soft start circuit device 10 attached. FIG. 8 shows the same instantaneous 3.5 amp current draw 820 consistent with capacitor charging and the like. However, also shown in FIG. 8, the current draw on the power supply shows a somewhat linear ramp 830 spread over approximately 30 seconds ultimately to the same steady state current of approximately 1.1 amp. However in this configuration, the RMS average current supplied by the power supply during charging ramp 830 is approximately 0.08 amps, representing a 93% reduction in the average current supplied by the power supply during the time duration ramp 830 required to bring the LED lighting device to maximum steady state light output. Once again, this much softer start of illumination intensity will both prolong the life of the LED(s) and reduce user discomfort.

Figure 9:
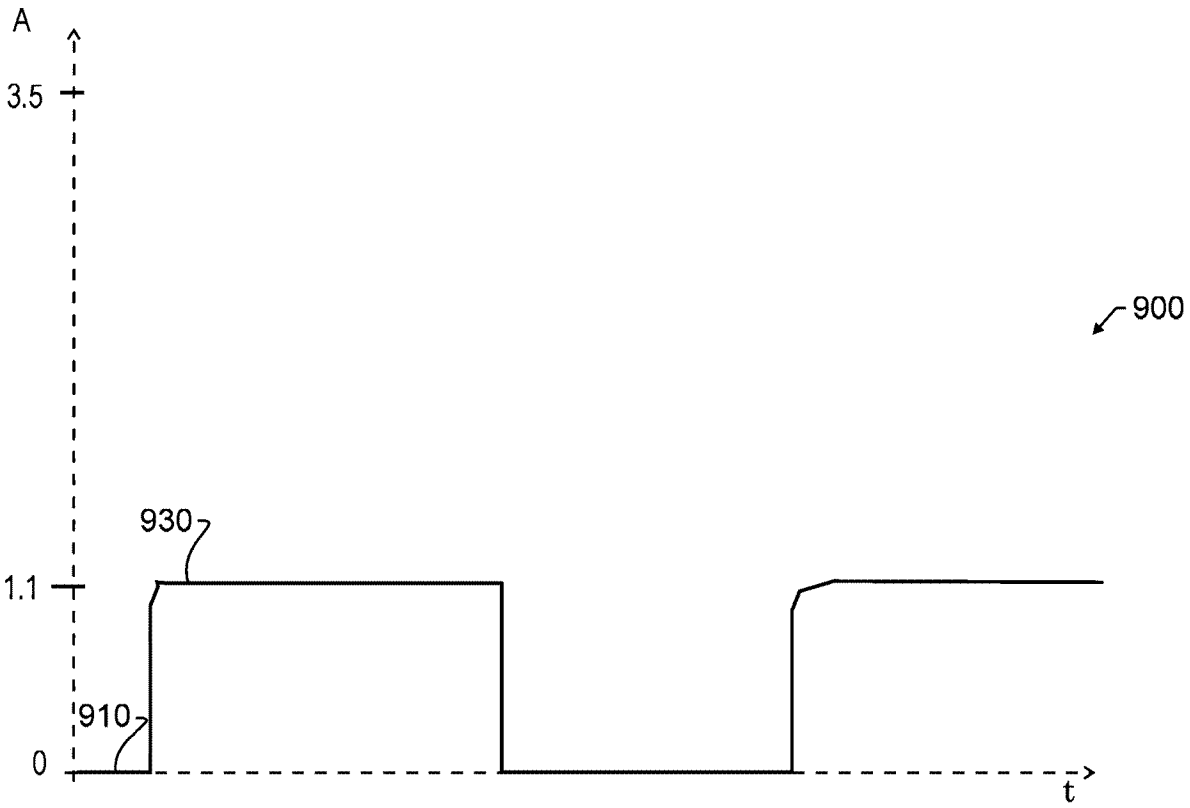
FIGS. 9 and 10 depict graphically the results of testing the inrush current for a zero crossing type power supply both without (FIG. 9) and with (FIG. 10) the preferred embodiment soft start circuit device of FIG. 1 attached thereto.
Figure 10:
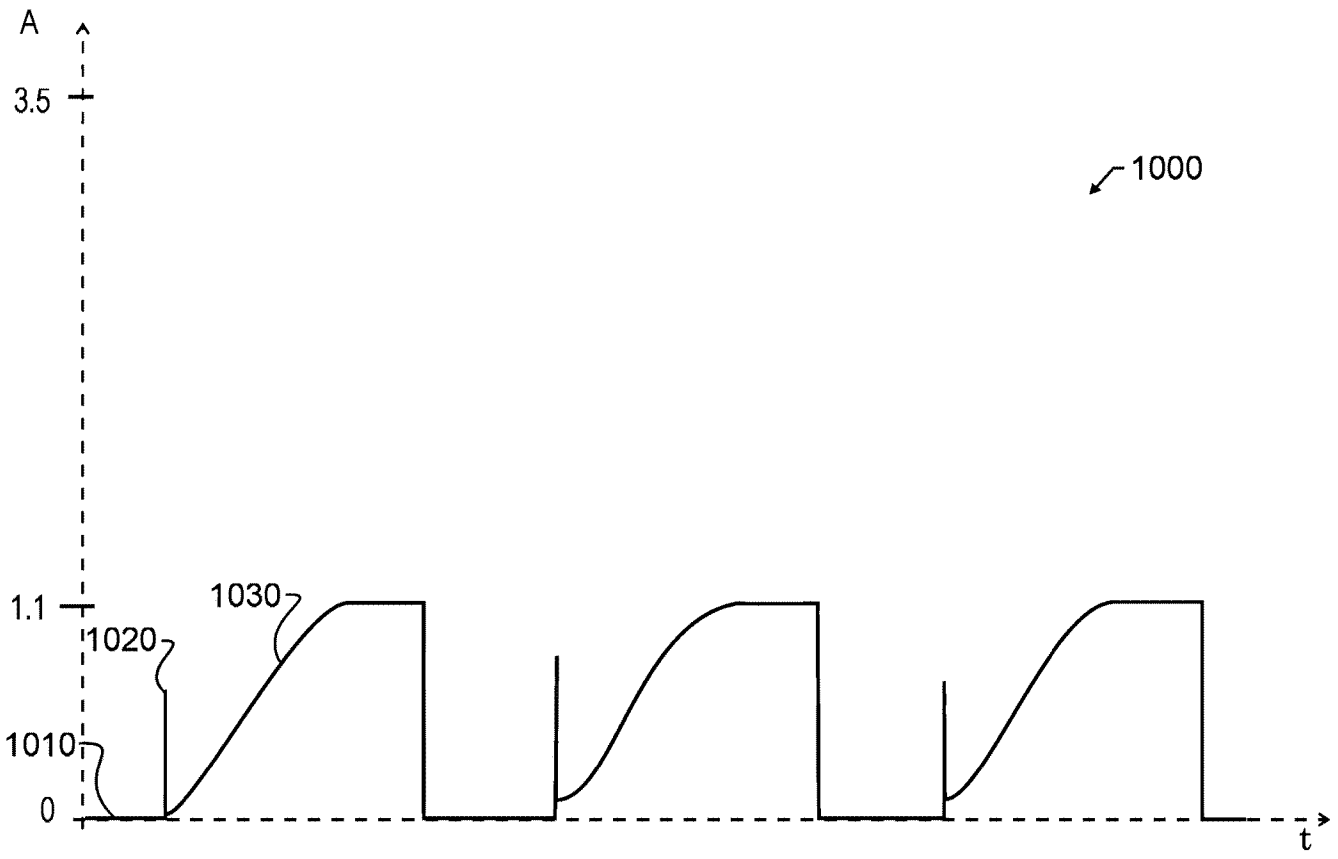

Once more, FIGS. 9 and 10 tell a similar story for zero crossing type power supplies. FIG. 9 shows the results of powering on and off a zero crossing type power supply without preferred embodiment soft start circuit device 10 attached. Reflecting the benefit of a zero crossing power supply, FIG. 9 avoids the instantaneous 3.5 amp inrush of current, and instead rises directly to the approximate 1.16 amp steady draw 930 on the power supply in a square wave type fashion. This is repeated over multiple on/off cycles with similar results. In contrast to this, FIG. 10 shows the same zero crossing power supply with preferred embodiment soft start circuit device 10 attached. FIG. 10 shows an instantaneous 0.6 amp inrush current draw 1020 consistent with capacitor charging and the like. Of note here is that even the inrush current draw 1020 is of lower amplitude than that of the steady operation state. Also shown in FIG. 10, the current draw on the power supply shows a somewhat linear ramp 1030 spread over approximately 30 seconds ultimately to the same steady state current of approximately 1.16 amps. In this configuration, the RMS average current supplied by the power supply during charging ramp 1030 is approximately 0.11 amps, representing a 91% reduction in the average current supplied by the power supply during the time duration ramp 1030 required to bring the LED lighting device to maximum/steady state light output.

Preferred embodiment soft start circuit device 10 provides automated soft start of the LED(s) without the inconvenience of manual intervention. Consequently, preferred embodiment soft start circuit device 10 may be installed in the field by electricians and other installers to retrofit existing 0-10 volt DC dimmer controlled LED drivers with the necessary electrical components to achieve automated soft start of the LED(s).

As may be apparent, the particular values for capacitor 51, 151 and resistor 54, 154 may be varied. One particular anticipated need for such adjustment is to adjust the time required to ramp up the LED output, such as in ramps 630, 830, 1030, in order to meet the goals or desires of a circuit designer. Another anticipated need is to accommodate a particular very divergent 0-10 volt DC dimmer output impedance, which would otherwise also alter the ramp time.

In addition to altering the time required to ramp up the LED illumination intensity to full intensity, the particular values for capacitor 51, 151 and resistor 54, 154 are in an alternative embodiment also varied to adjust the maximum achieved intensity. In one alternative embodiment, capacitor 51 comprises a 1,000 microfarad capacitor and resistor 54 comprises an 8 kilohm resistor. This combination may both soft start and ultimately dim light emitting diode (LED) devices to significantly reduced levels compared to nominal output. For exemplary and non-limiting purpose, in one case this reduced the LED lights to 40% of their nominal output, while ramping for about 30 seconds after energizing the LED lighting device. In another alternative embodiment, capacitor 51 comprises a 470 microfarad capacitor and resistor 54 comprises a 12,400 ohm resistor. In one case this reduced the light emitting diode (LED) devices to 60% of their nominal output on or about 30 seconds after energizing the LED lighting device. In yet another alternative embodiment, capacitor 51 comprises a 470 microfarad capacitor and resistor 54 comprises a 17,800 ohm resistor. In one case this reduced the light emitting diode (LED) devices to 80% of their nominal output on or about 30 seconds after energizing the LED lighting device.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A soft start circuit device configured to soft start light emitting diode (LED) devices, comprising:

a capsule having a wall separating an interior from an exterior thereof and providing electrical insulation and physical consolidation and isolation to said capsule interior;

a first wire and a second wire each passing from said capsule exterior through said capsule wall into said capsule interior;

a capacitor retained in said capsule interior having a first terminal electrically coupled to said first wire and a second electrical terminal electrically coupled to said second wire;

at least one indicium affixed with said first wire indicative of a 0-10 volt DC dimmer negative polarity connection; and at least one indicium affixed with said second wire having indicative of a 0-10 volt DC dimmer positive polarity connection;

said first wire configured to directly electrically connect to a negative polarity electrical junction between an output of a 0-10 volt DC LED dimmer and a dimmer input of an LED driver;

said second wire configured to directly electrically connect to a positive polarity electrical junction between said output of said 0-10 volt DC LED dimmer and said dimmer input of said LED driver.

2. The soft start circuit device of claim 1, further comprising a resistor retained in said capsule interior having a first terminal electrically coupled to said first wire and a second electrical terminal electrically coupled to said second wire.

3. The soft start circuit device of claim 2 wherein said resistor has a value of approximately 100,000 ohms, and said capacitor has a value of approximately 20 microfarads.

4. The soft start circuit device of claim 1, wherein said at least one indicium affixed with said first wire further comprises a tag.

5. The soft start circuit device of claim 4, wherein said at least one indicium affixed with said first wire further comprises a color-coded wire insulation.

6. The soft start circuit device of claim 1, wherein said at least one indicium affixed with said first wire further comprises a color-coded wire insulation.

7. The soft start circuit device of claim 1, wherein said capsule further comprises:

a generally cylindrical packaging tube;

a first end cap at a first longitudinal end of said generally cylindrical packaging tube; and a second end cap at a second longitudinal end of said generally cylindrical packaging tube distal to said first longitudinal end.

8. The soft start circuit device of claim 7, wherein said generally cylindrical packaging tube further comprises a polymer.

9. The soft start circuit device of claim 8, wherein said polymer further comprises a polycarbonate composition.

10. The soft start circuit device of claim 1, further comprising a sealant generally filling said capsule interior.

11. The soft start circuit device of claim 10, wherein said sealant further comprises a silicone elastomer.

12. The soft start circuit device of claim 10, wherein said capsule and said sealant each are at least in part one of translucent or transparent and are thereby configured to permit visual inspection of said capsule interior.

13. The soft start circuit device of claim 12, wherein said capsule further comprises a polycarbonate composition, and said sealant further comprises a silicone elastomer.

14. In combination, a 0-10 volt DC dimmer, an LED driver, and a soft start circuit device, said 0-10 volt DC dimmer comprising a positive polarity dimmer output and a negative polarity dimmer output;

said LED driver comprising a positive polarity dimmer input directly connected to said positive polarity dimmer output, a negative polarity dimmer input directly connected to said negative polarity dimmer output, a line voltage input, and an LED power supply output; and said soft start circuit device comprising:

a capsule having a wall separating an interior from an exterior thereof and providing electrical insulation and physical consolidation and isolation to said capsule interior;

a first wire and a second wire each passing from said capsule exterior through said capsule wall into said capsule interior; and a capacitor retained in said capsule interior having a first terminal electrically coupled to said first wire and a second electrical terminal electrically coupled to said second wire;

a resistor retained in said capsule interior having a first terminal electrically coupled to said first wire and a second electrical terminal electrically coupled to said second wire;

at least one indicium affixed with said first wire indicative of a 0-10 volt DC dimmer negative polarity connection; and at least one indicium affixed with said second wire indicative of a 0-10 volt DC dimmer positive polarity connection;

said soft start circuit device first wire directly electrically connected to said positive polarity dimmer output and to said LED driver positive polarity dimmer input, and said soft start circuit device second wire directly electrically connected to said negative polarity dimmer output and to said LED driver negative polarity dimmer input.

15. The combination 0-10 volt DC dimmer, LED driver, and soft start circuit device of claim 14, wherein said capsule further comprises:

a generally cylindrical polycarbonate packaging tube;

a first end cap at a first longitudinal end of said generally cylindrical polycarbonate packaging tube;

a second end cap at a second longitudinal end of said generally cylindrical polycarbonate packaging tube distal to said first longitudinal end; and a silicone elastomer sealant generally filling said capsule interior.

16. The combination 0-10 volt DC dimmer, LED driver, and soft start circuit device of claim 15, wherein said capsule and said sealant each are at least in part one of translucent or transparent and are thereby configured to permit visual inspection of said capsule interior.

17. The combination 0-10 volt DC dimmer, LED driver, and soft start circuit device of claim 14, wherein said positive polarity dimmer output further comprises said at least one indicium indicative of a 0-10 volt DC dimmer negative polarity connection; and wherein said negative polarity dimmer output further comprises said at least one indicium indicative of a 0-10 volt DC dimmer positive polarity connection.

18. In combination, a 0-10 volt DC dimmer, an LED driver, and a soft start circuit device, said 0-10 volt DC dimmer comprising a positive polarity dimmer output and a negative polarity dimmer output;

said LED driver comprising a positive polarity dimmer input, a negative polarity dimmer input, a line voltage input, and an LED power supply output; and said soft start circuit device consisting of:

a first wire directly electrically connected to said positive polarity dimmer output and directly electrically connected to said LED driver positive polarity dimmer input;

a second wire directly electrically connected to said negative polarity dimmer output and directly electrically connected to said LED driver negative polarity dimmer input;

a capsule separating an interior from an exterior thereof and providing electrical insulation and physical consolidation and isolation to said capsule interior, said first wire and said second wire each passing from said capsule exterior through said capsule wall into said capsule interior;

a capacitor retained in said capsule interior having a first terminal electrically coupled to said first wire and a second electrical terminal electrically coupled to said second wire;

a resistor retained in said capsule interior having a first terminal electrically coupled to said first wire and a second electrical terminal electrically coupled to said second wire.

19. The combination 0-10 volt DC dimmer, LED driver, and soft start circuit device of claim 17, wherein said capsule comprises a capsule wall and a capsule sealant.

20. The combination 0-10 volt DC dimmer, LED driver, and soft start circuit device of claim 19, wherein said capsule wall comprises:

a generally cylindrical and light transmissive polycarbonate packaging tube;

a first end cap at a first longitudinal end of said generally cylindrical polycarbonate packaging tube; and a second end cap at a second longitudinal end of said generally cylindrical polycarbonate packaging tube distal to said first longitudinal end;

and wherein said capsule sealant comprises a light transmissive silicone elastomer sealant generally interior of said capsule wall.

21. The combination 0-10 volt DC dimmer, LED driver, and soft start circuit device of claim 18, wherein said first wire comprises a copper wire, insulation surrounding the copper wire, and at least one indicium indicative of a 0-10 volt DC dimmer negative polarity connection; and wherein said second wire comprises a copper wire, insulation surrounding the copper wire, and at least one indicium indicative of a 0-10 volt DC dimmer positive polarity connection.

* * * * *